United States Patent [19]

Shields

[11] Patent Number: 4,596,072

[45] Date of Patent: Jun. 24, 1986

[54] METHOD AND APPARATUS FOR ATTACHING SINGLE PIECE CONNECTORS TO A FLAT MULTICONDUCTOR CABLE

[76] Inventor: Charles E. Shields, 655 Woodland St., Crystal Lake, Ill. 60014

[21] Appl. No.: 496,461

[22] Filed: May 20, 1983

[51] Int. Cl.[4] ..... H01R 43/04

[52] U.S. Cl. ..... 29/861; 29/749

[58] Field of Search ..... 101/73; 40/316; 29/861, 29/749; 118/DIG. 21, DIG. 22

[56] References Cited

U.S. PATENT DOCUMENTS

| | | | |
|---|---|---|---|
| 1,904,254 | 4/1933 | Scrantom | 101/73 |
| 4,228,709 | 10/1980 | Guzay, Jr. et al. | 29/868 X |
| 4,253,222 | 3/1981 | Brown et al. . | |
| 4,370,806 | 2/1983 | Funcik et al. | 29/748 X |

FOREIGN PATENT DOCUMENTS

WO82/52486 5/1982 PCT Int'l Appl. .

*Primary Examiner*—Howard N. Goldberg
*Assistant Examiner*—Carl J. Arbes

[57] ABSTRACT

An apparatus and method for attaching single piece connectors to the conductors of a flat, multiconductor cable is disclosed, in which a plurality of single piece connector feed assembly stations is provided, along with a notching station for removing insulating strips between adjacent conductors of the cable at that portion of the cable to be prepared to receive a single piece connector. A marking station is also disclosed for placing an identifiable mark on the cable, which in one form of the invention is accomplished by spraying ink onto a portion of cable length having connectors attached, and in another embodiment of the invention by applying pressure sensitive tape. Each connector feed assembly station for attaching single piece connectors includes a ramming piston which supports a single piece connector to be attached to a cable portion, and a diametrically opposed crimping piston, which has a plurality of crimping fingers projecting from its forward end, which crimping fingers force conductors into the contact wells of the single piece connector supported in the ramming piston when the conductors of a cable portion are positioned between the two pistons.

62 Claims, 9 Drawing Figures

METHOD AND APPARATUS FOR ATTACHING SINGLE PIECE CONNECTORS TO A FLAT MULTICONDUCTOR CABLE

BACKGROUND OF THE INVENTION

The present invention is directed to a method and apparatus for attaching one single piece connector or a plurality of single piece connectors to a flat multiconductor cable which has a plurality of parallel, spaced conductors coated with insulation, with each conductor further being separated from an adjacent conductor by an insulating strip positioned between the conductors. Such flat, multiconductor cable is used in systems where it is necessary to connect various system components, such as printed circuit boards. The single piece connectors are attached at locations along the length of the cable corresponding to the constraints of the system in which it is to be utilized.

In applicant's copending application, Ser. No. 351,595, filed Feb. 23, 1982, entitled "Method and Apparatus for Applying Two Piece Connector Blocks to Multiconductor Cable," which is incorporated herein by reference, an apparatus and method are disclosed for attaching two-piece connectors to flat multiconductor cable. In such apparatus, there is provided a plurality of two-piece connector feed assembly stations where the two-piece connectors are attached to different portions of a cable. Each feed assembly station has a pair of diammetrically opposed cylinders in each of which is slidingly mounted a piston, with each cylinder of each station being separated from the other cylinder by a channel formed in a lower mounting plate, which channel extends in a direction parallel with the width of a cable supplied to the feed stations, so that a carriage mounting a supply of cable may be moved laterally in the cable width direction to any one of the feed assembly stations in any desired, preprogrammable manner. Cable fed to each feed assembly station is positioned between the pair of cylinders, so that when the respective pistons of the cylinders are extended by respective air cylinders, the cable portion positioned at the feed assembly station is sandwiched between the two pistons. Each of the pistons carries half of a two-piece connector to be attached to a cable portion positioned at the feed assembly station, which halves are staked to the conductors of the cable by ramming the pistons toward each other, so that one half of the connector having staking pins thereon pierces through the conductors of the cable portion and into the other mating half of the connector positioned in the other piston. Each piston has a ram head end surface in which is formed a cut-out for mounting differently-sized connector inserts, which hold a respective half of a connector therein for ramming toward the other half to accomplish the attachment of the connector to a cable portion. Each cylinder is further provided with an opening formed in its upper surface so that a storage magazine mounted above the opening will allow one half of a two-piece connector to fall through the opening and into the connector insert of the piston's ram head end surface. The piston is formed with an upwardly sloping surface from the ram head end surface rearwardly, so that the bottom-most connector half in the magazine rides therealong as the piston is reciprocated by an air cylinder until the rearward-most retraction of the piston, whence the bottom-most connector half falls into its insert at the ram head end surface of the piston. The length of stroke of each piston's rod is variably controlled to accommodate different cable sizes and different connector types.

In the aforesaid copending application, it is also disclosed that a microprocessor controls the operation of the various control devices by controlling the motor of the carriage moving means and the motor of the cable-advancing drive roller, and the operation of the solenoids of the feed devices' air cylinders. Further, there is also disclosed a separate cutting station where cable lengths may be formed having a pair of ends, which cutting station has a cutting mechanism which cuts a cable at any desired portion, which cutting mechanism has a solenoid also controlled by the microprocessor. Thus, the entire operation of the apparatus is preprogrammable and changeable so that any length of cable may be formed with any number and any type of two-piece connectors. Since each two-piece connector feed assembly station may be provided with a different type of two-piece connector, the number of different types of two-piece connectors that may be attached to a cable length is limited only by the number of such feed assembly stations provided in the apparatus. Further, by interchanging each of the connector halves from one magazine associated with one air cylinder of a feed station to the other magazine of the other air cylinder of the same feed station, the same type of connector may be attached to a cable portion such that it is oriented 180 degrees out of phase relative to another same-type connector attached to another portion of the cable.

In another of applicant's copending application, Ser. No. 490,380, filed May 2, 1983, entitled "Testing Device for Testing the Connections of a Connector and a Cable Portion Attached to the Connector," which is hereby incorporated by reference, there is disclosed a method and system for testing the connections of a connector attached to the conductors of a cable immediately after or during attachment of a connector to a cable. The testing is carried out at each feed assembly station where a connector is attached to the conductors of the cable, and includes, in the case of female connectors, a reciprocably mounted testing plate having a plurality of projection fingers extending toward the connections of the connector attached to a portion of a cable. The projection fingers extend through the ram head end surface of at least one of the pistons of the feed station through holes formed in the ram head end surface, so that when extended, the fingers contact the connections of the connector attached to the conductors of a cable. Each testing projection finger is connected to a testing instrument, as an ampmeter, via a wire lead, so that tests for continuity may be performed. The testing method and system also discloses embodiments for sending a signal along the conductors of the cable so that the testing instrument may test the connections.

As disclosed in the aforesaid application, Ser. No. 490,380, in the case of male connectors which have been attached to a cable portion, the plate member with testing projection fingers is replaced by a plate having a plurality of testing receptacles in which the male contacts of a male connector enter immediately after or during attachment to a cable portion. Each feed station of the apparatus disclosed in applicant's copending application, Ser. No. 351,595, may include a male connector testing device and a female connector testing device, where the male connector testing device is mounted in one cylinder of the feed assembly station, while the female connector testing device is mounted in the other, diametrically opposed cylinder of the feed assembly device, to thus accommodate connectors of the male and female type at each feed assembly station, where their connections may be tested for continuity.

The present invention provides an apparatus and method for automatically attaching at least one single piece connector to a cable length. Whereas the apparatus in applicant's copending application, Ser. No. 351,595, discloses mainly the attachment of two-piece connectors to cable portions, the present invention discloses a method and apparatus for attaching single piece connectors to cable portions. In the instant case, single piece connectors have just one piece, to which the conductors of the cable are staked. Such a single piece connector is shown as prior art in FIGS. 6 and 7 of the instant drawing. In such a single piece connector, each conductor is staked to a staking element mounted in a contact well, each contact well being separated from another by a partition. In order to prepare a cable portion for reception of its conductors in the contact wells of the single piece connector and for staking to the staking elements in the contact wells, the portion is first notched before such reception. Such notching removes the insulating strips between adjacent conductors along a portion of the length of the strips, so that clearance is provided to allow insertion of the conductors at a portion of the cable to receive a single piece connector into the contact wells of the single piece connector.

SUMMARY OF THE INVENTION

It is, therefore, the primary object of the present invention to provide an apparatus and method that automatically notches a cable portion and attaches it to a single piece connector.

It is another object of the present invention to provide a plurality of single piece feed assembly stations so that a plurality of different types of single piece connectors may be attached to a cable length at different portions thereof, and so that the same type of single piece connector may be oriented on a cable portion 180 degrees out of phase with another same-type single piece connector attached to another cable portion.

It is still another object of the present invention to provide a separate notching station in lateral alignment with the plurality of single piece connector feed stations, which notching station notches a portion of a cable to receive a single piece connector thereon. The notching station removes strips of insulation between adjacent conductors at the portion of the cable which is to be prepared to receive a single piece connector thereon.

It is still another object of the present invention to provide each feed station with automatic feed means to automatically and continually feed single piece connectors to a piston which stakes a connector to a portion of a cable positioned at the feeding station.

It is, further, an object of the present invention to provide each feeding station with crimping fingers which force each prepared conductor strip into a contact well of a single piece connector. The crimping fingers are preferably mounted for reciprocal movement diametrically opposite to the piston carrying a single piece connector thereon for staking the connector to the conductors of cable portion.

It is still another object of the present invention to provide a separate marking station where an identifiable mark, such as a trademark, may be imprinted or otherwise placed onto a portion of a cable assembly. The marking station is in lateral alignment with the plurality of single piece feed assembly stations, so that a carriage mounting a supply of cable may be brought to any station at any time, in a preprogrammable manner.

It is still another object of the present invention to provide an apparatus that will allow for the attachment of single piece connectors and two-piece connectors to a cable length at different portions of the cable length, in any desired and preprogrammable fashion which two-piece connectors are attached by feed stations disclosed in applicant's copending application, Ser. No. 351,595.

In the apparatus of the present invention, a plurality of single piece feed assembly stations are provided, which stations are mounted along a channel in lateral alignment with each other along the channel, in a direction parallel with the width of a cable which is to receive connectors on different portions thereof. Each single piece feed assembly station includes a ramming piston which supports and stakes a single piece connector to the conductors of a portion of a cable, and a diammetrically opposed crimping piston which has a plurality of crimping fingers mounted at its forwardmost end for insertion into the contact wells of a single piece connector supported on the ramming piston, to thus force the conductors of the cable into the staking elements of the contact wells, whereby contact is made. Each cable portion to receive a single piece connector is prepared for such reception at a notching station laterally aligned with the plurality of feed stations along the channel. The notching station removes strips of insulation between adjacent conductors, so that clearance of the partition walls of the contact wells of the single piece connector is provided.

A microprocesor controls the sequence of operation of the apparatus, so that any desired pattern of connectors and length of cable may be produced. Further, it is within the purview of the present invention, to provide along with the single piece feed assembly stations, two-piece feed assembly stations, as disclosed in applicant's copending application, Ser. No. 351,595, so that a hybrid cable assembly having single piece connectors and two-piece connectors attached thereto may be produced, and also so that a user of the apparatus may at any time provide cable assemblies having only single piece connectors or two-piece connectors thereon.

The present invention also has a marking station which, in a first embodiment, prints or sprays ink onto a portion of the cable to label it, and, in another embodiment, applies pressure sensitive tape to a cable portion for identification.

The present invention also provides for the crimping fingers to serve as testing fingers, which testing fingers are disclosed in applicant's copending application, Ser. No. 490,380.

It is further provided that the carriage of the apparatus of the present invention mounts a cutting mechanism for cutting a cable portion at a desired location, which cutting mechanism travels with carriage as the carriage positions different cable portions at the connection feed assembly stations.

BRIEF DESCRIPTION OF THE DRAWING

The invention will be more readily understood with reference to the accompanying drawing, wherein.

DETAILED DESCRIPTION OF THE INVENTION

Figure 1:
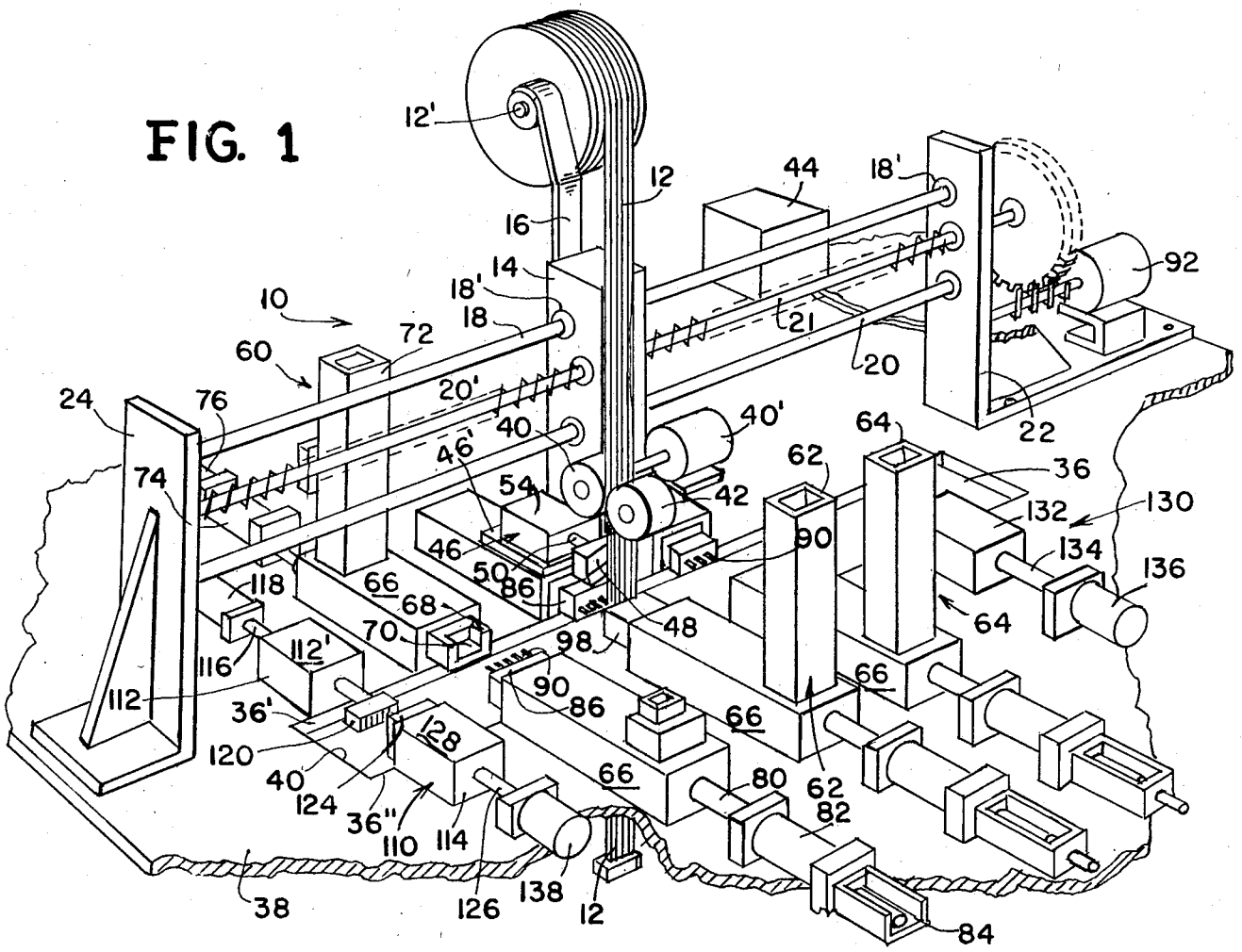
FIG. 1 is a perspective view showing the apparatus for automatically attaching single piece connectors to lengths of flat multiconductor cable according to the present invention with a separate marking station for placing an identifying mark on the cable lengths where single piece connectors have been attached.

Referring now to the drawing in greater detail, the apparatus of the present invention for attaching single piece connectors to a flat multiconductor cable length is indicated generally by reference numeral 10 in FIG. 1. The apparatus 10 includes a supply reel 12' which stores a supply of conventional flat multiconductor cable, which cable typically includes a plurality of conductors lying parallel to one another and in substantially the same plane. Each conductor is separated from an adjacent conductor in the cable by an insulation strip, and all of the conductors are further coated from below and from above with further insulation.

The supply reel 23 is fixedly mounted to a carriage 14 by a bracket 16 extending vertically upwardly from the top surface of the carriage 14. An axle 12' rotatably mounts the supply reel 12 to the bracket 16. The carriage 14 is mounted for lateral, horizontal reciprocation by a pair of guide bars 18, 20, which in turn are fixed to end brackets 22, 24. Bushings 18' and 20' allow for the horizontal sliding of the carriage 14 along the guide rods 18, 20. Screw shaft 21 and motor 32 rotating screw 21 translate the carriage 14 along guide rods 18, 20. The carriage as well as mounting and driving mechanisms for the carriage are disclosed in applicant's copending application, Ser. No. 351,595, filed Feb. 23, 1982.

The guide bars 18, 20 and the carriage 14 are in vertical alignment with a channel 36 formed in a base plate 38 mounted below the guide bars 18, 20, as clearly shown in FIG. 1. A drive roller 40 driven by a motor 40', and an idler roller 42 are mounted on the carriage 14 so that cable lengths from the reel 12 may be advanced downwardly toward the channel 36 in a selected and preprogrammed manner, as described in applicant's copending application, Ser. No. 351,595. A microprocessor 44 which is preprogrammable controls the operation of the motors 40' and 32. The nip defined between the rollers 40 and 42 is positioned directly above the mid-line of the channel 36 so that as a cable length is traversed in the horizontal direction along the guide bars 18, 20 a portion of the cable length advanced downwardly toward the channel 38 will be positioned midway between the side surface 36' and 36'' of the channel 36.

Also mounted on the carriage 14 is a cutting mechanism 46, which is mounted on a lower, rearwardly extending bracket 46' of the carriage 14, as seen in FIG. 1. The cutting mechanism 46 has a cutter 48 having an angular, sloping blade of conventional design used to cut through a portion of the cable positioned in front of the cutter so as to define an end of the cable length. The cutter 48 is reciprocally mounted by a rod 50 reciprocally mounted by an air cylinder 54 of conventional design. When the cutting mechanism 46 is activated by the microprocessor 44 via a conventional valve mechanism to cut a cable portion to define an end of a cable length, the necessary stiffness for the cutting is provided by the fixed portions of the cable. One such anchored portion is that part of the cable positioned in the nip between the rollers 40 and 42, while the other anchored portion of the cable is provided by the part of the cable receiving a connector at any of the connector feed assembly stations. The connector feed assembly station, while its pistons are extended to attach a connector to the cable portion positioned between the piston heads, assures the other fixed end for purposes of cutting, so that the actual cutting via cutting mechanism 46 is necessarily carried out before the pistons of the feed assembly station are retracted.

Such an arrangement of the cutting mechanism, which is mounted for movement with the carriage 14, saves time, since it obviates the translation of the carriage to a separate cutting station, as is the case in the apparatus disclosed in applicant's copending application, Ser. No. 351,595. It is also noted that the cable 12 may be cut at any time during the operation of the apparatus, as for cutting away defective connector attachments discovered during a testing procedure, as disclosed in applicant's copending application, Ser. No. 490,380. In such a step, or when cutting an initial end of a new cable supply reel which is to have its end cut to form a clean, straight edge, the same procedure applies. However, for the case where an initial end is to be cut for a new supply reel, a respective connector feed assembly having its connectors removed is utilized, so that the other fixed end is provided, but without the attachment of a connector on that part of the cable fixed between the pistons being performed. The cutting by the angular, sloping forward edge surface of the cutter 48 shears the cable across its width as the cutter 48 is advanced. Whenever an end of a cable length is to be defined, the cutting mechanism 46 is activated to extend the cutter and thus cut the cable portion positioned directly in front of the cutter 48. Such cutting of a portion of a cable length is carried out initially when a new supply reel 12 is provided for the apparatus 10, to define a first end. Thereafter, whenever precise cable lengths are desired, which cable lengths may or may not have at least one connector attached to a portion of its length, the cutting mechanism will again be activated to cut the cable. The exact location of the cut end of the cable length is controlled by the microprocessor 44, which controls the operation of the air cylinder 54, as disclosed in applicant's copending application, Ser. No. 351,595. Cutter 48 will also be activated to cut away defective lengths of cable, where, for example, a short has been found to exist in one of the connector contacts with a cable conductor, as disclosed in applicant's copending application, Ser. No. 490,380, 5/2/83.

As shown in FIG. 1, the apparatus 10 is provided with a plurality of connector feed assembly stations 60, 62, and 64. Each connector feed assembly station is similar in construction and has a pair of oppositely disposed cylinders 66, 66' mounted on opposite sides of the channel 36 and in alignment with each other. Associated with the cylinder 66 is a piston mounted for reciprocation within the cylinder 66, which piston has a ram head end portion 68 having a cut-out formed therein to receive an insert 70. The insert 70 is designed to have the necessary shape and configuration for receiving a particularly single piece connector. For each particular single piece connector of unique size and shape, a special insert 70 is positioned in the ram head end portion of the piston. Mounted on the upper surface of the cylinder 66 is a storage magazine 72 storing single piece connectors 91, shown in FIGS. 6 and 7. The bottom of the magazine 72 is open and cooperates with a similarly shaped opening formed in the top surface of the cylinder 66, so that a single piece connector may fall through the openings onto the sloped upper front surface of the piston, as disclosed in applicant's copending application, Ser. No. 351,595. The piston with its piston ram head end portion 68 is reciprocated by an air cylinder 74 suitably connected to a source of compressed air, and by a solenoid 76 as disclosed in applicant's copending application, Ser. No. 351,595. The stroke of the piston is also adjustable, as disclosed in the above-mentioned copending application, so that variously sized connectors and cables may be accommodated.

Figure 6:
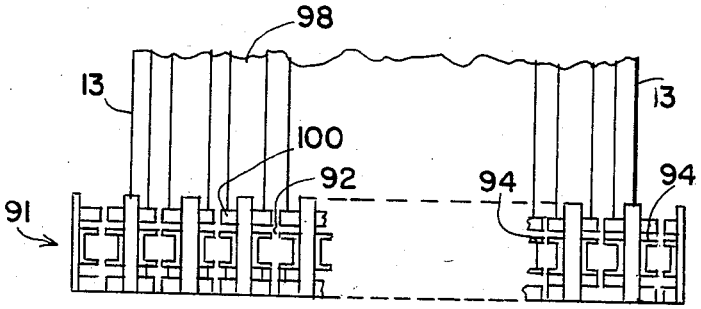
FIG. 6 PRIOR ART
FIG. 6 is a top view showing a conventional single piece connector which is attached to a portion of a flat multiconductor cable prepared at the notching station of the present invention.
Figure 7:
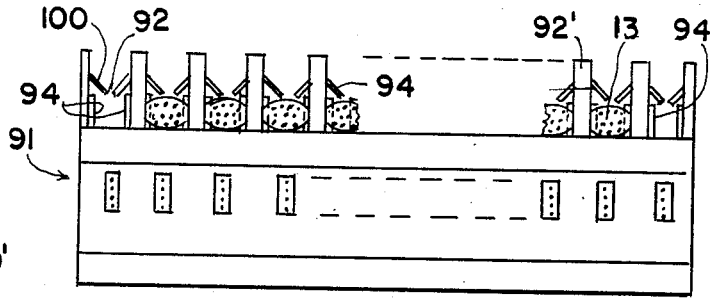
FIG. 7 PRIOR ART
FIG. 7 is a side view of the single piece connector of FIG. 6.

The cylinder 66' is also provided with a piston having a rod 80 which is slidingly mounted in the cylinder 66', which rod 80 extends rearwardly into another air cylinder 82 controlled by another solenoid 84, as disclosed above. The piston is provided with a ram head end surface block 86 having a plurality of spaced and parallel crimping fingers 90. Fingers 90 are directly opposite the insert 70 holding a single piece connector such that the fingers are in alignment with the contact wells 92 of a single piece connector. As shown in FIGS. 6 and 7, each single piece connector 91 includes a plurality of evenly spaced contact wells 92 in which are received the conductors of a cable length. Each contact well 92 receives one conductor of the cable. As shown in FIGS. 6 and 7, each contact well 92 has a staking element 94 of U-shaped cross-section so that a conductor end portion 13 may be placed between the legs of the element 94. Each leg has sharpened side end edges to pierce through the insulation coating covering each conductor to contact the conductor to form a connection.

Each well 92 is separated from an adjacent well by a partition 92', so that in order for each conductor to snugly fit into a respective well and be staked to the staking element 94, the insulating strip separating a conductor from an adjacent conductor must be removed at that portion of the cable where a single piece connector is to be attached to the cable. As shown in FIG. 6, each conductor 13 is freed from an adjacent conductor 13 by removing the insulating strips between the connectors, to thus form voids 98 between the conductors, which allow for the attachment of the single piece connector to the conductors of the cable.

Since each partition 92' has a pair of sloping detent tabs 100 extending from the top portion of both end edges of the partition, which tabs project into the interior of a well and extend laterally therein so that a small gap is defined therebetween, a conductor may be forced downwardly passed the tabs toward a respective contact staking element 94. The tabs 100 define a gap therebetween that is slightly smaller than the diameter of the conductor being forced therethrough. Further, the legs of the contact staking element are so spaced from each other that each conductor must be forced therein because the inwardly projection side end cutting edges of the legs of the staking element are spaced a smaller distance apart than the diameter of the conductor being forced therein. Thus, a force need be applied to force each conductor through and past the tabs 100 and through the space between the legs of the staking element 94 where the inwardly projecting cutting side end edges of each leg of the staking element cuts through the insulation surrounding each conductor to contact the conductor itself. To provide this force to position the conductor in a respective staking element where its insulation is pierced inwardly by the projecting cutting side end edges of the staking element, the plurality of crimping fingers 90 are provided. Each crimping finger 90 is diammetrically opposite a respective contact well when a connector is positioned in insert 70 and at a height on its carrying block 86 such that it is in alignment with the contact staking element 94, so that when the piston of cylinder 66' is extended, each crimping finger 90 enters into a respective contact well 92 and forces a conductor portion positioned thereat passed the tabs 100 and into the contact staking element 94, where it is pierced by the inwardly projecting cutting side end edges of each leg of the staking element to contact the conductor. After such staking of the conductors to the staking elements, the crimping fingers are withdrawn to their original position, as shown at station 64 in FIG. 1.

As described above, it is necessary to remove the insulating strips between the conductors of the cable at that portion which is to be attached to the contact wells of the single piece connector. Thus, the cable must be initially notched at the portion thereof where it is to receive a single piece connector, which notching removes the insulating strips between the conductors along a length of each strip sufficient to provide clearance of the partitions separating the contact wells of the single piece connector, as described above. Preferrably, the length of each conductor portion separated from an adjacent conductor by having the insulating strip therebetween removed by notching is slightly greater than the length of the partition 92' shown in FIG. 6. For example, the length of the portion of each conductor, and therefore each void, may be $\frac{1}{8}$ of an inch longer than the length of a partition 92', which will allow for the necessary clearance of the partitions and ease of insertion of the conductors into the wells.

Figure 2:
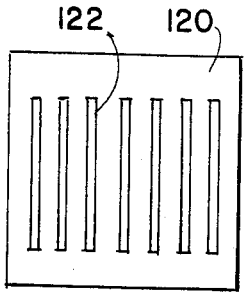
FIG. 2 is a front view of the notching member of the present invention which notches a portion of a flat multiconductor cable to prepare it for reception of a single piece connector.
Figure 3:
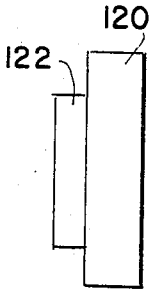
FIG. 3 is a side view of the notching member of FIG. 2.

To notch a cable portion, a separate notching station 110 is provided. The notching of a cable portion may be carried out at a cable end prepared when the cutting mechanism 46 has cut the cable to define an end of a cable length, or the cable may be notched at any intermediate portion of cable length where a single piece connector is to be attached. The notching station 110 has a notching device 112 and a diametrically opposed block member 114. The notching device 112 has a reciprocal rod 116 slidingly mounted in a housing 112', and a solenoid 118 for reciprocating the rod 116 between an extended, notching position and a retracted rest position. At the forward end of the rod 116 there is mounted a detachable cutting head 120 having a plurality of cutting dies 122, best seen in FIGS. 2 and 3. Each cutting die 122 is of the same shape and size, and, as shown in FIG. 2, is preferably of rectangular cross section to conform to the shape of the portion of the insulating strip to be removed between adjacent conductors. The cutting dies 122 are equally spaced apart along the width of the cutting head 120 and project outwardly from the front face of the cutting head a distance necessary to cut through the insulating strips of the cable positioned between adjacent conductors.

The block member 114 has a block head 124 mounted on a reciprocable rod 126 slidingly mounted in a housing 128. Another solenoid 130 reciprocates the block head 124 between an extended position where the cutting dies 122 abut thereagainst during notching of a cable portion, and a retracted position where the block head is at rest. As disclosed in copending application, Ser. No. 351,595, the stroke of the rods 116 and 126 may be adjusted to accommodate different sizes of cable and insulating strips. The block head 124 may, in an alternative form of the invention, be mounted stationarily on the rod 126, with the rod 126 also being stationary, with no solenoid 138 being required. Further, the cutting head 120, as mentioned above, is releasingly mounted to the rod 116, so that different types of cutting heads 120 may be easily mounted to the rod 116, in order to accommodate cables of different size and thickness. Another cutting head 120 may have the size and shape of its cutting dies different from that shown in FIG. 2, and may also have those cutting dies spaced differently to accommodate different spacing of the conductors of a cable. The cutting head 120 is releasably mounted to the forward end of the rod 116 by any conventional means, such as by a guide-and-key arrangement or any detent mechanism well-known in the art, so as to allow for easy replacement of differently-sized cutting heads. It can be seen in FIG. 1, that when a portion of cable is ready to be prepared to receive a single piece connector, the carriage 14 will move along the guide rods 18, 20 to position that portion of cable above the notching station 110. The portion of the cable to be notched is advanced by drive roller 40 and idler roller 42 until it is positioned at the same level as the cutting dies 122.

In FIG. 1, there are shown three single connector feed assembly stations and one notching station. Any number of such connector feed assembly stations may be provided along the channel 36, all such stations lying in lateral alignment along the length of the channel, as shown in FIG. 1. It is also shown in FIG. 1 that two feed assembly stations 62 and 64 have their respective magazines on a first side of the channel adjacent the channel wall 36'' while the other feed assembly station 60 has its magazine 72 on the other side of the channel adjacent the channel wall 36'. Thus, the connector attached to a cable portion from the stations 62 and 64 will be oriented 180 degrees relative to a connector attached at the feed assembly station 60. Depending upon the requirements and end use of the cable length, one or all three of these feed assembly stations may be utilized to attach connectors, so that a connector may be aligned 180 degrees out of phase with another connector. Further, where each of the feed assembly stations 62 and 64 are in the same orientation, the magazines of each station preferably store different types of single piece connectors so that a variety of such connectors may be attached to a cable length, with only the number of such feed assembly stations limiting the number of different types of connectors employed. For example, feed assembly station 62 may have housed in its magazine female single piece connectors, while the magazine for the connector feed assembly station 64 may house male-type single piece connectors. Which types of connectors actually attached to a cable length is solely determined by the end use requirements of that cable length.

As disclosed in applicant's copending application, Ser. No. 351,595, a number of two-piece connector feed assembly stations may be provided that attach two-piece connectors to cable portions. It is in the purview and scope of the present invention that the apparatus 10 of the present invention may be provided with additional connector feed assembly stations of the type disclosed in the aforesaid copending application, so that one of or a plurality of two-piece connector feed assemblies may be provided along with the single piece connector feed assembly stations. For example, the apparatus 10 of the present invention may be provided with three single piece connector feed assembly stations, such as 60, 62, and 64 as shown in FIG. 1, and three additional two-piece connector feed assembly stations disclosed in the aforesaid copending application. Thus, there would be six such feed assembly stations. Though it is often the case that any type cable used will either utilize single piece connectors only or two piece connectors only, it is within the scope and purview of the present invention to provide a cable assembly where a hybrid of single piece connectors and two-piece connectors are attached along the same cable assembly. In such a hybrid assembly, the apparatus 10 of the present invention will operate as herein disclosed and as disclosed in applicant's copending application, Ser. No. 351-595. The apparatus of the present invention including sets of single piece connector feed stations and two-piece connector feed stations, can produce a cable assembly of only single piece connectors or a cable assembly of only two-piece connectors.

It is further disclosed in applicant's other copending application, Ser. No. 490,380, that a testing system is provided with the apparatus 10 of the present invention and that apparatus disclosed in applicant's copending application, Ser. No. 351,595. Such testing system includes reciprocable insertion fingers which are insertable at each feeding station into the contacts of the connector attached at the feeding station in the case of a female connector. In the case of a male connector, the insertion fingers are replaced by a plate having a plurality of contact receptacles into which the male contacts of the connector project during testing. As also disclosed in the other copending application, Ser. No. 490,380, the testing fingers may also be utilized to crimp the conductors to the contact spiking elements when a single piece connector is attached to a cable portion. Therefore, it is also within the purview of the present invention that the crimping fingers 90 may also serve as the testing fingers in the case of single piece connectors, with each crimping finger 90 being electrically connected to a testing instrument via a wire lead, as disclosed in the aforesaid copending application.

The apparatus 10 of the present invention is also provided with a marking station 130 positioned along the channel 36 in lateral alignment with the other stations, so that the carriage 14 may position a cable portion at the marking station at any desired time during the preparation of a cable assembly having connectors thereon. The marking station places an identifiable mark on a portion of a cable length assembly, such as a trademark or stock number and the like, or any other identifying mark. The mark may be placed on any desired location of the cable length assembly and at any desired and opportune moment during the formation of a cable length having connectors attached therealong. The marking station can also be of the type which prints any number of characters on the cable, the content of which is controlled by the microprocessor.

In a first embodiment of the marking station 130, ink is sprayed onto a portion of a cable length. In this embodiment, a housing 132 slidingly mounts a rod 134 which is reciprocated via a solenoid 136. At the forward end of the housing 132, in the interior thereof, there is mounted a flexible diaphragm 138 (see FIG. 5) having a dome shape, so as to define an ink storage chamber 138' in which ink to be sprayed onto a portion of the cable length is stored. The central apex portion of the diaphragm 138 is fixedly connected to the end 134' of the rod 134 for movement therewith. Thus, upon extension of the rod 134 by actuation of the solenoid 136, the ink stored in the chamber 138' is pressurized and forced to be sprayed out through holes 140 (see FIG. 4) formed through the front face 132' of the housing 132. The number and configuration of the holes 140 may be that which is desired to form the mark on the cable portion. Though not shown, the housing 132 is preferrably has a closable access opening to the ink storage chamber 138' so that ink may be periodically supplied in the chamber 138'. To insure that the arrangement of holes formed in the front face 132' is that which is imprinted on a cable portion, the front face 132' of the housing 132 is mounted in overhanging fashion over the edge 36'' of channel 36, so that when the ink is sprayed through the holes, little divergence is allowed. However, the front face 132' may be mounted along the same line created by the front faces of the cylinders 66', 66, and 66 which are mounted on the same side of the channel 36 as the housing 132. While a flexible and movable diaphragm has been shown as providing the means for spraying the ink onto a cable portion, it is to be understood that other spraying methods and structures may be used to accomplish the spraying. For example, the well-known dot-matrix ink spraying system may be used which is controlled by the microprocessor 44 in the well-known manner. Other well-known and conventional inking or printing systems may also be used.

Figure 8:
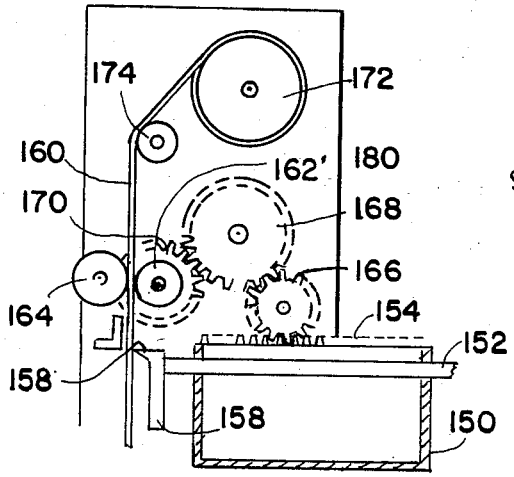
FIG. 8 is a side, elevational view of another embodiment of the marking device of the present invention in which pressure sensitive tape is applied onto a portion of a cable length having single piece connectors attached thereto.
Figure 9:
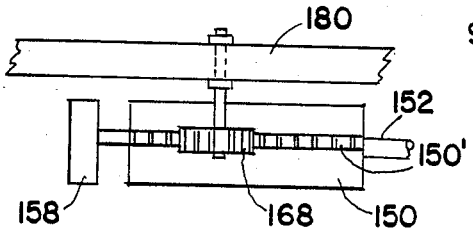
FIG. 9 is a partial, top view showing the rack and pinion of the marking station of FIG. 8, where parts have been removed to show the arrangement of the rack and pinion for advancing in stepping fashion a length of pressure sensitive tape.

In another form of the marking station 130, a device for applying pressure sensitive tape is shown in FIGS. 8 and 9. In this form, a housing 150 slidingly mounts a rod 152 at the upper portion of the housing 150. The rod 152 is reciprocated by a solenoid, as in the manner described with regards to the first form of the marking station. The rod 152 is provided with a rack 154 having gear teeth thereof facing upwardly and sliding in a groove 150' on the upper surface of the housing 150, as shown in FIG. 9. As the rod 152 reciprocates, the rack attached slides therewith in the groove 150'. At the forward-most end of the rod 152, there is provided a tape application member 158 which has a sharp upper edge surface 158' for cutting away a portion of pressure sensitive tape positioned in front of the application member 158 upon forward movement of the rod 152 and member 158 attached thereto. Upon forward movement of the application member 158, the portion of the pressure sensitive tape 160 directly in front of the front face of the member 158 will be cut away from the rest of the tape 160 and conveyed and pressed against a portion of a cable length.

Alternatively, instead of providing a cutting edge surface 158' on the application member, a guide bracket mounted between application member 158 and rollers 162, 164, which advance a portion of the pressure sensitive tape downwardly to position it in front of the front face of the application member 158, may have its lower edge surface formed into a sharp edge so that when the rod 152 is moved toward a cable portion, the portion of the pressure sensitive tape 160 adjacent the lower edge surface of the guide bracket will be shorn away.

To insure that a strip of the pressure sensitive tape 160 is always positioned in front of the application member 158 prior to each marking operation, a gearing arrangement is provided which will advance a length of pressure sensitive tape upon the return of the rod 152 to its rest, non-retracted position. A spur gear 166 rotatably mounted by conventional bearing means on a side support plate 180 is provided, which spur gear meshes with the rack gear 154 on the upper surface of the rod 152. Spur gear 166 in turn is in meshing engagement with another spur gear 168 (see FIG. 8). A second spur gear 168 (not shown) is mounted parallel and connected with the first spur gear 168 to rotate therewith which, in turn, is in meshing engagement with spur gear 170 mounted on drive roller shaft 162'. A one-way clutch transmits only counter-clockwise rotation of the spur gear 170, as viewed in FIG. 8 so that the drive roller 162 advances the pressure sensitive tape 160 only upon the forward movement of the rod 152. The nip defined between the drive roller 162 and idler roller 164 impels the pressure sensitive tape downwardly, as viewed in FIG. 8. Pressure sensitive tape 160 is supplied from a storage reel 172 mounted above the gearing arrangement, and a guide roller 174 turns the tape toward the nip of the rollers 162, 164. In FIG. 9, gear 170, rollers 162 and 164, and reel 172 are removed to show the construction of the rack gear and groove.

While one form of pressure sensitive tape application means has been shown, it is to be understood that other means may be provided and used to accomplish the same results. It is also to be understood that the microprocessor 44 controls the sequence of operations so that any desired arrangement may be attained for a cable assembly. The microprocessor controls the operation of the motors 40', and 32, as well as the solenoids 118, 76, 138, 136, 54, and 84, in a manner disclosed in applicant's copending application, Ser. No. 351,595.

Figure 4:
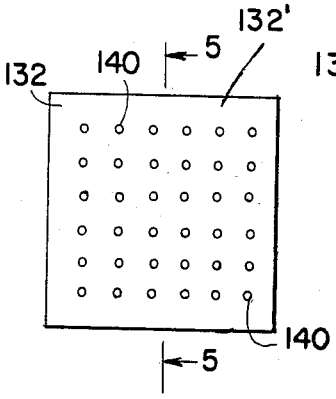
FIG. 4 is a front view of a first embodiment of the marking device of the present invention which sprays ink onto a portion of a cable length prepared with connectors.
Figure 5:
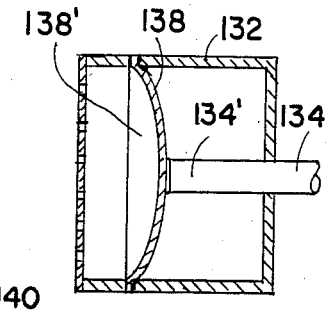
FIG. 5 is a sectional view of the marking device taken along line 5—5 of FIG. 4.

Further, two marking stations may be provided on the apparatus 10 of the present invention, where one such marking station is an ink spraying station, as for example, the one shown in FIGS. 4 and 5, while the other marking station is a pressure sensitive tape application device, as for example, the one shown in FIGS. 8 and 9. The two may be mounted diammetrically opposite to each other on opposite sides of the channel 32, or alternatively may be mounted on the same side of the channel in lateral alignment with the other stations along that side of the channel.

While specific embodiments and forms of the present invention have been shown and described, it is to be understood that numerous changes and modifications may be made therein without departing from the scope, breadth and spirit of the invention as set out in the appended claims.

What is claimed is:

1. A method of forming cable assemblies, the method comprising:

selectively advancing a length of multiconductor cable;

selectively attaching a least one connector to the advanced cable; and, selectively marking the advanced cable with an identifying mark.

2. The method as set forth in claim 1 wherein the marking step includes spraying a marking fluid onto the multiconductor cable to provide the identifiable mark.

3. The method as set forth in claim 1 wherein the marking step includes applying a pressure senstive material to the advanced cable.

4. The method as set forth in claim 1 further including the step of cutting the advanced multiconductor cable subsequent to attachment of the connector.

5. The method as set forth in claim 4 further including repeating the connector attaching step a plurality of times before performing the cutting step such that the cable assembly includes a plurality of connectors attached therealong.

6. The method as set forth in claim 1 further including the step of removing non-conductive insulating material from between conductors of a portion of the multiconductor cable prior to the connector attaching step, the connector attaching step including attaching the connector adjacent cable portion with removed insulation.

7. The method as set forth in claim 1 further including the step of testing an attached connector electrical contact with conductors of the multiconductor cable.

8. A method of forming a cable assembly, the method comprising:

advancing a length of multiconductor cable which includes a plurality of electrical conductors with electrically non-conductive insulation disposed therebetween;

selectively attaching a connector having a plurality of electrically conductive segments to the multiconductor cable such that the electrically conductive segments are disposed in an electrically conductive relationship with the conductors; and, testing for electrical conductivity between the connector electrically conductive segments and the cable conductors.

9. The method as set forth in claim 8 further including the step of applying an identifiable mark to the cable.

10. The method as set forth in claim 8 further including prior to the attaching step, the step of removing electrical insulation from between electrical conductors of a portion of the cable and wherein the attaching step includes attaching the connector adjacent the cable portion with removed insulation.

11. The method as set forth in claim 10 further including the step of crimping the conductors and the connector electrically conductive segments into a firm electromechanical relationship.

12. The method as set forth in claim 10 wherein the step of removing insulation includes punching segments of insulation from the cable with a plurality of cutting dies.

13. The method as set forth in claim 10 further including the step of cutting the advanced multiconductor cab:e subsequent to attachment of the connector.

14. The method as set forth in claim 13 wherein the steps of removing insulation and attaching connectors are repeated a plurality of times before the cutting step such that the cable assembly includes a plurality of connectors attached therealong.

15. A method of forming cable assemblies, the method comprising:

selectively advancing a length of multiconductor cable having a plurality of electrical conductors separated by electrically non-conductive insulating material;

selectively bringing the advanced cable into registration with each of a plurality of work stations;

at one of the work stations, performing the step of removing insulation from between electrical conductors along a selected portion of the multiconductor cable;

at another work station selectively attaching a connector to the selected multiconductor cable portion; and, cutting the multiconductor cable subsequent to the attaching step.

16. The method as set forth in claim 15 wherein the insulation removing step includes punching out segments of insulation with a plurality of cutting dies.

17. The method as set forth in claim 15 further including the steps of repeatedly advancing the multiconductor cable, bringing the cable into registration with an additional work station and removing the cable insulation thereat, and bringing the cable into registration with yet another work station and connecting a connector thereat prior to the cutting step, whereby a cable assembly with a plurality of connectors attached thereto is formed.

18. The method as set forth in claim 15 wherein the advancing step includes advancing the multiconductor cable vertically downward and wherein the step of bringing the cable into registration includes translating the cable horizontally relative to the work stations.

19. The method as set forth in claim 15 further including the step of bringing the advanced cable into registration with a two-piece connector attaching work station and attaching a two-piece connector to a section of the multiconductor cable thereat.

20. The method as set forth in claim 15 wherein the step of attaching the connector includes inserting electrically conductive segments of the connector between the conductors and crimping the electrically conductive segments and the conductors into firm electrical contact.

21. The method as set forth in claim 20 further including the step of testing for an electrically conductive relationship between the electrically conductive segments and the conductors.

22. The method as set forth in claim 15 further including the step of marking a multiconductor cable with an identifiable mark.

23. A method of forming cable assemblies, the method comprising:

selectively advancing a length of multiconductor cable vertically downward, the multiconductor cable including a plurality of electrical conductors separated by electrically non-conductive insulation;

selectively translating the multiconductor cable along an array of work stations disposed horizontally relative to each other to bring the advanced multiconductor cable selectively into registration with each of the work stations, the work stations including:

a notching work station for selectively punching out sections of the insulation with cutting dies to remove insulation from between the conductors, a marking work station for selectively marking the cable with an identifiable mark, a connector attachment station for selectively attaching a connector to the multiconductor cable;

while the advanced multiconductor cable is in registration with the work stations, performing at least one of the steps of: punching out insulation from between conductors of a selected portion of the advanced cable, marking the cable with an identifiable mark, attaching a connector to the cable, and testing for an electrically conductive relationship between the cable conductors and an attached connector; and, cutting the cable.

24. An apparatus for attaching at least one connector to a cable length at at least one portion thereof, comprising:

a frame assembly;

means for supporting a flat, multiconductor cable on which at least one connector is to be attached, the cable supporting means being operatively connected with the frame assembly;

at least one connector attachment station for attaching a single-piece connector to a portion of the cable, the connector attachment station including:

a connector ramming means for spiking electrical contacts of the connector to a portion of the cable, the connector ramming means being operatively connected to the frame assembly for reciprocating movement relative thereto, a plurality of testing fingers operatively connected with the frame assembly for forcing cable conductor portions and the connector contacts connector into electrical contact and for testing for electrical continuity of the contacts of the single piece connector with the cable conductors.

25. An apparatus for attaching at least one connector to a multiconductor cable, the apparatus comprising:

a frame assembly;

means for supporting the multiconductor cable on which the connector is to be attached, the cable supporting means being operatively connected with the frame assembly;

at least one notching station for notching a portion of the multiconductor cable, the notching station being operatively connected with the frame assembly;

at least one connector attachment station for automatically attaching a single-piece connector to the multiconductor cable, the connector attachment station being operatively connected with the frame assembly; and, at least one marking station for applying a mark to a portion of the multiconductor cable, said at least one marking station being operatively connected with the frame assembly such that the marking station, said at least one notching station, and said at least one connector attachment station are mounted in alignment in a lateral direction parallel with the width of the cable.

26. The apparatus according to claim 25, further comprising at least one connector feed assembly station for attaching a two-piece connector to a portion of a cable, said at least one connector feed assembly station for attaching a two-piece connector being in alignment with the other said stations.

27. The apparatus according to claim 26 wherein said means for supporting the multiconductor cable comprises carriage means mounted for translation in a direction parallel with the width of the cable; said carriage means moving the cable between said stations so as to provide a desired pattern of at least one connector attached to a cable length; means for mounting said carriage means with said frame assembly for translating in said direction parallel with the width of the cable, the mounting means being operatively connected with the frame assembly and the carriage means; and means for advancing the cable in a direction along the length thereof so as to position the cable adjacent at least the deisred one of said stations, the advancing means being operatively connected with the carriage means.

28. The apparatus according to claim 27, further comprising a microprocessor for controlling the sequence of operation of attachment of at least one connector to the cable; said microprocessor being programmable and controlling the operation of said advancing means and said translating means to position cable portions at at least the desired one of said stations, the microprocessor being operatively connected with the advancing means and the translating means.

29. The apparatus according to claim 28, wherein said at least one marking station comprises an application means for applying a mark onto a cable portion, said application means comprising means for forming an indentifiable mark on a cable portion and means for reciprocating said means for forming an identifiable mark, the identifiable mark forming means being operatively connected with the reciprocating means and the reciprocating means being operatively connected with the frame assembly; said microprocessor being operatively connected with the reciprocating means for controlling the operation thereof.

30. The apparatus according to claim 29, wherein said means for forming an identifiable mark comprises a pressure-sensitive tape applying means.

31. An apparatus for attaching at least one connector to a cable on at least one portion thereof, comprising:

means for supporting the cable portion on which the at least one connector is to be attached;

at least one connector attachment station for attaching the connector to a selected portion of the cable, the connector attachment station being operatively connected with the cable supporting means such that at least the selected cable portion extends thereadjacent; and at least one marking station for marking at least a section of the cable with an identifiable mark, the marking station being operatively connected with the cable supporting means such that at least the marked cable section extends thereadjacent.

32. The apparatus according to claim 31, wherein said at least one marking station comprises means for spraying ink onto the cable section.

33. The apparatus according to claim 31, wherein said at least one marking station comprises means for applying pressure sensitive tape onto the cable section.

34. The apparatus according to claim 31, wherein said at least one connector attachment station and said marking station are disposed in lateral alignment in a direction taken along a width of a cable supplied to said stations.

35. The apparatus according to claim 31, wherein said means for supporting comprises a carriage means, and a cutting means mounted on said carriage means for cutting a portion of a cable to define an end thereof.

36. The apparatus according to claim 35, wherein said means for supporting further comprises means for reciprocably mounting said carriage means for movement in a direction parallel with a width of the cable.

37. The apparatus according to claim 32, wherein said ink spraying means comprises a casing having a front end surface formed with a plurality of holes through which ink is sprayed; an ink storage chamber within said casing for storing ink to be sprayed positioned at a forward end of said casing in communication with said front end surface; and means for forcing the ink in said storage chamber through said plurality of holes.

38. The apparatus according to claim 33, wherein said means for applying pressure sensitive tape comprises a cylinder; a reciprocably mounted rod in said cylinder; a plate member mounted at one end of said rod for movement therewith; storage means for supplying pressure sensitive tape to a front surface of said plate member; means operatively connected between said storage means and said rod for intermittently advancing a length of pressure sensitive tape to said front surface of said plate member; and means for reciprocating said rod, so that upon outward movement of said plate member, tape is carried therewith for application to the cable.

39. An apparatus for forming cable assemblies, the apparatus comprising:

a frame assembly;

cable advancing means for advancing a multiconductor cable vertically downward, the cable advancing means being connected with the frame assembly for relative reciprocating generally horizontal movement therebetween; and, an array of work stations operatively connected with the frame assembly vertically below the cable advancing means such that the advanced cable is adapted to be brought into registration with each of the work stations, the work station array including at least one marking station for selectively marking a portion of the cable in registration therewith, at least one notching station for selectively removing insulation from between electrical conductors of a portion of the cable in registration therewith, at least one connector attachment station for selectively attaching a connector having electrically conductive segments with the notched portion of the cable such that the connector electrically conductive segments are attached in an electrically conductive relationship with cable conductors, and a test station for measuring the electrically conductive relationship between the cable conductors and the connector conductive segments to test whether the connector conductive segments are each in an appropriate electrical contact with a selected cable conductor.

40. An apparatus for forming cable assemblies, the apparatus comprising:

a cable supply supporting frame assembly;

cable advancing means for selectively advancing a multiconductor cable therefrom, the cable advancing means being operatively connected with the cable supply supporting frame assembly;

a work station frame assembly, the work station frame assembly being movably connected with the cable supply frame assembly;

translating means for selectively causing the cable supply and work station frame assemblies to undergo relative reciprocating movement, the translating means being operatively connected with the cable supply and work station frame assemblies;

at least one connector attachment station for selectively attaching connectors to selected portions of the advanced cable, the connector attachment station being operatively connected with the work station frame assembly; and, at least one marking station for marking at least selected portions of the advanced cable with an identifying mark, the marking station being operatively connected with the work station frame assembly.

41. An apparatus for forming cable assemblies, the apparatus comprising:

a cable advancing means for selectively advancing a multiconductor cable;

at least one connector attachment station for selectively attaching connectors to selected portions of the advanced cable, the connector attachment station being operatively connected with the cable advancing means to receive multiconductor cable advanced thereby, the connector attachment station including:

a reciprocating member mounted with the connector attachment station for reciprocating movement toward and away from the advanced multiconductor cable, the reciprocating member being operatively connected with a means for receiving a connector having electrical conductive segments and for advancing the connector toward the advanced multiconductor cable to stake the connector thereto with the connector electrically conductive segments being connected in a electrically conductive relationship with selected conductors of the cable, and a plurality of fingers connected with the connector station and disposed opposite the advanced cable from the reciprocating member such that the fingers assist in urging the cable conductors into the electrically conductive relationship with the connector electrically conductive segments.

42. The apparatus as set forth in claim 41, wherein the fingers are electrically conductive and are operatively connected with means for testing the electrically conductive relationship of the connector segments and the cable conductors.

43. An apparatus for forming cable assemblies, the apparatus comprising:

a cable supply frame assembly;

a cable advancing means for advancing multiconductor cable, the cable advancing means being operatively connected with the cable supply frame assembly;

a work station frame assembly;

a notching station for removing insulation from between conductors of a portion of the multiconductor cable, the notching station being operatively connected with the work station frame assembly;

at least one connector attachment station for attaching connectors to the notched cable portion, the connector attachment station being operatively connected with the work station frame assembly; and, translating means for selectively translating the cable supporting and work station frame assemblies relative to each other for selectively bringing the advanced multiconductor cable into registration with the notching and connector attachment stations, the translating means being operatively connected with the cable supporting and work station frame assemblies.

44. The apparatus as set forth in claim 43 wherein the notching station includes a first notching member mounted to the work station frame assembly for reciprocating movement toward and away from the multiconductor cable disposed in registration with the notching station, the first notching member including a means for cutting away insulation connected to one end thereof for selectively notching the registered cable portion and a first block member disposed opposite a registered cable portion against which the first notching member is adapted to abut during notching of the cable portion.

45. The apparatus as set forth in claim 44 further including a second reciprocating notching member mounted to the work station frame assembly in alignment with the first reciprocating notching member for selectively notching a second portion of a registered multiconductor cable.

46. The apparatus as set forth in claim 44 wherein the notching member includes a plurality of parallel spaced cutting dies projecting outwardly therefrom toward the block member, the cutting dies being spaced in conformity with a spacing of conductors of the multiconductor cable such that the cutting dies cut away insulating portions from between the conductors.

47. The apparatus as set forth in claim 46 wherein the cutting dies are removably mounted on the reciprocating notching member, whereby cutting dies of various shapes and sizes may be readily connected with the notching member for notching cables of various sizes and for the reception of connectors of various configurations.

48. The apparatus as set forth in claim 43 wherein the connector attaching station includes a reciprocating attachment member mounted with the work station frame assembly for reciprocating movement toward and away from a registered multiconductor cable for spiking a connector thereto and a crimping means disposed opposite the registered multiconductor cable from the reciprocating attachment member for inserting a portion of each conductor of the multiconductor cable into a respective contact well of the connector such that electrical contact segments thereof are forced through any insulation around the cable conductors and into electrical conduit therewith.

49. The apparatus as set forth in claim 48 wherein the crimping means includes a plurality of parallel spaced fingers, each disposed in alignment with a respective contact well of the connector.

50. The apparatus as set forth in claim 49 further including finger reciprocating means for selectively reciprocating the insertion fingers toward and away from the registered cable portion.

51. The apparatus as set forth in claim 49 wherein the fingers are electrically conductive and further including electrical continuity checking means operatively connected with the fingers for checking electrical continuity between the connector contact segments and the cable conductors.

52. The apparatus as set forth in claim 43 wherein the notching station includes a plurality of cutting members spaced to cut away insulation portions of the multiconductor cable between adjacent conductor portions, a block member mounted with the work station frame assembly opposite a registered cable portion from the plurality of cutting members in alignment therewith, and reciprocating means for selectively reciprocating the cutting members against the block member, the reciprocating means being operatively connected with the cutting members and the work station frame assembly.

53. The apparatus as set forth in claim 43 further including at least one two-piece connector attachment station for selectively attaching two-piece connectors to a cable portion disposed in registration therewith, the two-piece connector attachment station being operatively connected with the work station frame assembly.

54. The apparatus as set forth in claim 43 wherein the work station frame assembly includes at least one track member disposed generally parallel to the work stations and wherein the cable supply frame assembly is movably mounted on the track member for translating movement therealong.

55. The apparatus as set forth in claim 43 further including a cutting means for selectively cutting the cable, the cutting means being operatively connected with the cable supply frame assembly and disposed in alignment with the advanced cable.

56. The apparatus as set forth in claim 55 wherein the cutting means includes a cutting blade and means for reciprocating the cutting blade in a direction transverse to the advanced cable.

57. The apparatus as set forth in claim 43 further including at least one marking station for selectively applying a mark to the cable, the marking station being operatively connected with the work station frame assembly.

58. The apparatus as set forth in claim 57 wherein the marking station includes spraying means for spraying a coloring agent onto the cable in a preselected pattern.

59. The apparatus as set forth in claim 43 further including a microprocessor for controlling the cable advancing means, relative movement between the cable supply and work station frame assemblies, the notching station, and the attachment station for bringing selected portions of the advanced cable into registration with the notching and attaching stations in a preselected sequence, the microprocessor being operatively connected with the translating means, the cable advancing means notching station, and the attachment station.

60. An apparatus for forming cable assemblies, the apparatus comprising:

a frame assembly;

an array of work stations mounted to the frame assembly in a spaced relationship in a first direction therealong, the work stations including at least one connector attachment station for selectively attaching a connector to a multiconductor cable;

a track means operatively connected with the frame assembly and extending generally in the first direction;

a carriage movably mounted to the track means for translating movement therealong generally in the first direction, such that the carriage is adapted to be translated into alignment with each of the work stations;

a multiconductor cable advancing means operatively connected with the carriage for selectively advancing a multiconductor cable therefrom toward the work stations, such that the multiconductor cable is selectively advanceable into registration with each of the work stations; and, a cutting means for selectively severing the multiconductor cable advanced by the advancing means, the cutting means being mounted to the carriage to undergo translating movement therewith.

61. The apparatus as set forth in claim 60 wherein the cutting means includes a cutting member mounted for reciprocating movement relative to the carriage.

62. The apparatus as set forth in claim 61 wherein the reciprocating cutting member is mounted generally in alignment with the work station array such that a work station in registration with the advanced multiconductor cable holds the multiconductor cable relatively stiff to facilitate severing of the cable by the reciprocating cutting member.

* * * * *